US005552584A

United States Patent [19]

Idebro

[11] Patent Number: 5,552,584

[45] Date of Patent: Sep. 3, 1996

[54] METHOD FOR HUMIDITY-EMISSION CONTROL OF A MICROWAVE OVEN, AND MICROWAVE OVEN WITH HUMIDITY-SENSOR CONTROL ACCORDING TO THE METHOD

[75] Inventor: Mats G. Idebro, Linköping, Sweden

[73] Assignee: Whirlpool Corporation, Benton Harbor, Mich.

[21] Appl. No.: 490,267

[22] Filed: Jun. 14, 1995

[30] Foreign Application Priority Data

Jun. 15, 1994 [SE] Sweden ..... 9402107

[51] Int. Cl.[6] ..... H05B 6/68

[52] U.S. Cl. ..... 219/707; 219/703; 99/325

[58] Field of Search ..... 219/707, 705, 219/703, 702, 757; 99/325, DIG. 14, 451

[56] References Cited

U.S. PATENT DOCUMENTS

| | | | |
|---|---|---|---|
| 3,839,616 | 10/1974 | Risman | 219/707 |
| 4,171,382 | 10/1979 | Buck | 219/707 |
| 4,791,263 | 12/1988 | Groeschel, Jr. | 219/707 |
| 4,841,111 | 6/1989 | Kokkeler et al. | 219/757 |
| 4,864,088 | 9/1989 | Hiejima et al. | 218/707 |
| 5,436,433 | 7/1995 | Kim et al. | 219/703 |
| 5,464,967 | 11/1995 | Gong | 219/707 |

FOREIGN PATENT DOCUMENTS

| | | | |
|---|---|---|---|
| 0023971 | 7/1980 | European Pat. Off. | H05B 6/68 |
| 0078607 | 2/1982 | European Pat. Off. | H05B 6/68 |
| 0268329 | 11/1987 | European Pat. Off. | H05B 6/68 |
| 0289000 | 4/1988 | European Pat. Off. | H05B 6/68 |

*Primary Examiner*—Philip H. Leung

*Attorney, Agent, or Firm*—Stephen D. Krefman; Mark A. Davis

[57] ABSTRACT

In a microwave oven, a procedure for cooking or heating food is controlled by means of one or more humidity sensors (11) which sense the humidity emission from the food or dish. The control is based on the sensing of relative humidity variations and require access to an initial humidity value or reference value, which is established through a calculation process eliminating the effect of residual humidity remaining in the oven while saving time when starting the cooking or heating procedure.

10 Claims, 2 Drawing Sheets

Figure 1:
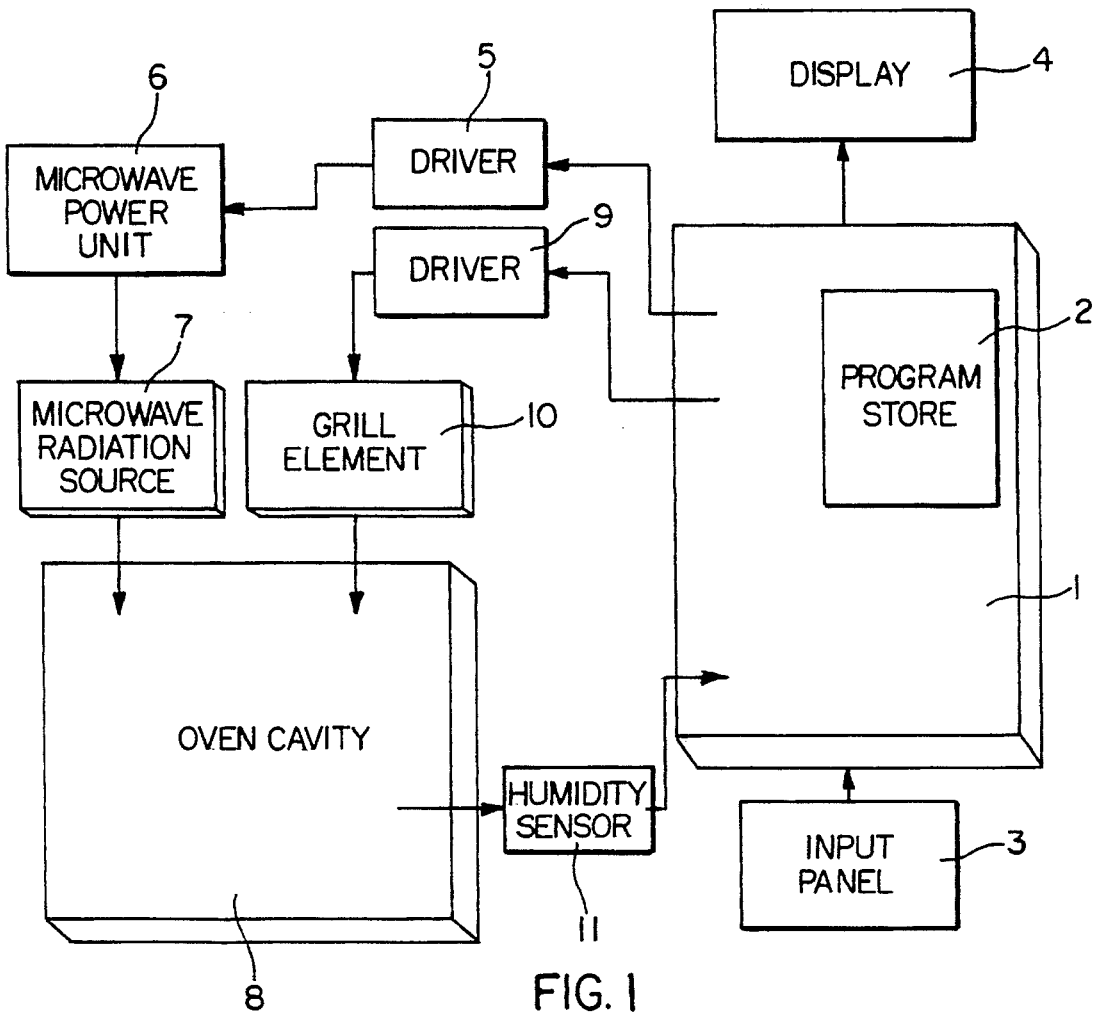

METHOD FOR HUMIDITY-EMISSION CONTROL OF A MICROWAVE OVEN, AND MICROWAVE OVEN WITH HUMIDITY-SENSOR CONTROL ACCORDING TO THE METHOD

This invention relates to a method for controlling, in a microwave oven, a procedure for cooking or heating food or a dish of food, by sensing the humidity emission from the food or dish, said oven comprising a cavity, a microwave radiation source, a control unit for controlling the feeding of microwaves to the cavity, a humidity sensor for transmitting a sensed humidity value as a control parameter to the control unit, and a device adapted to ventilate the cavity and controllable by the control unit. The invention further concerns a microwave oven adapted to operate in accordance with the method.

There are prior-art microwave ovens with one or more humidity sensors for sensing the humidity emission from food or a dish of food in order to control a cooking or heating procedure, e.g. the thawing of deep-frozen food. SE Patent 8604868-3 teaches instances of such microwave ovens. In these contexts, it is common to utilise the humidity of the ventilating air from the cavity as control parameter. Since the humidity of the ventilating air is affected by the humidity of the surrounding air, which in turn varies in the environments where the microwave oven is used, the variation in air humidity during the cooking or heating procedure is commonly utilised as control parameter. This type of humidity control requires that the control unit of the microwave oven has access to a relevant reference value for the air humidity when starting the procedure. An incorrect reference value will have an adverse effect on the cooking results.

One prior-art method for obtaining a reference value comprises the step of measuring the air humidity of the ventilating air when starting the cooking or heating procedure. One instance of this method is disclosed in EP Patent 0 289 000, in which the program flow chart of FIG. 13 begins with the sensing of an initial air-humidity value. This initial value may, however, be misleading, if the oven cavity is not dry at the outset, but contains residual humidity and condensate from previous cooking procedures. If so, the humidity sensor will sense a humidity value which primarily is a combination of the residual humidity and the humidity of the surrounding air. Using such a combined humidity value as initial value for the humidity control provides the control unit with incorrect information and has an adverse effect on the cooking procedure.

In another prior-art method, the lowest air-humidity value measured during the heating procedure is used as reference value. Instances of this method are taught in EP Patent 0 078 607 (see especially FIGS. 4A–D). In this case, one may, however, obtain an incorrect lowest air-humidity value if the humidity emission from the food or dish placed in the cavity for heating begins even before the remaining residual humidity has been vented off. Also in this case, the cooking results will suffer.

These deficiencies of the prior-art ovens could be avoided by actuating, before starting the cooking or heating procedure, the ventilating device of the oven (normally a fan) for airing the cavity until the air humidity has stopped to decrease and has assumed a stable, lowest value. With such a solution, however, the cooking or heating procedure would be prolonged by from about 20 sec to 3 min. Such a prolongation is frowned upon by the user.

The object of the invention is to remedy the above-mentioned drawbacks of prior-art microwave ovens, without entailing the additional drawback of a prolongation of the cooking or heating procedure, and to enable a relevant reference humidity value to be established.

According to the invention, this object is attained by a method which is of the type described by way of introduction and which is characterised by the steps of: actuating the ventilating device for initial removal of residual humidity from the oven; calculating an expected final air-humidity value for the residual humidity during said initial removal on the basis of the sensed humidity values and an algorithm for humidity calculation; and using the calculated final air-humidity value as reference value when implementing a humidity-emission-controlled cooking or heating procedure with the aid of said humidity sensor.

The method according to the invention saves time, as compared with the time it would take to remove all residual humidity from the oven by airing. This is achieved by calculating an expected final air-humidity value, i.e. the value that would have been attained if airing had continued. The calculation is, among other things, based on the insight that the residual humidity in the cavity decreases exponentially with respect to the airing time. By using a thus-calculated final air-humidity value as reference value for the subsequent procedure, the cooking results are improved without any noticeable prolongation of the procedure.

According to the invention, a microwave oven for cooking or heating food or a dish of food, comprising a cavity, a microwave radiation source, a control unit for controlling the feeding of microwaves to the cavity, a humidity sensor for sensing the humidity emission from the food or dish and returning the sensed humidity value as a control parameter to the control unit, and a device adapted to ventilate the cavity and controllable by the control unit, is characterised in that the control unit is adapted to actuate the ventilating device for initial removal of residual humidity from the oven when starting a cooking or heating procedure controlled by the humidity sensor, that calculating means are provided for calculating an expected final air-humidity value for the residual humidity during said initial removal, and that the control unit is adapted to utilise the calculated final air-humidity value as a reference value for the humidity-sensor control.

The control unit of such a microwave oven normally includes a microprocessor which can be programmed to implement one or more automatic cooking programs. Thus, implementation of the invention in such a microwave oven merely requires a slightly expanded control program for the microprocessor. In turn, this means that the microwave oven according to the invention enables improved cooking results without any noticeable increase in production costs for large series. Further distinctive features of the method and the microwave oven according to the invention are recited in the appended claims.

Figure 2:
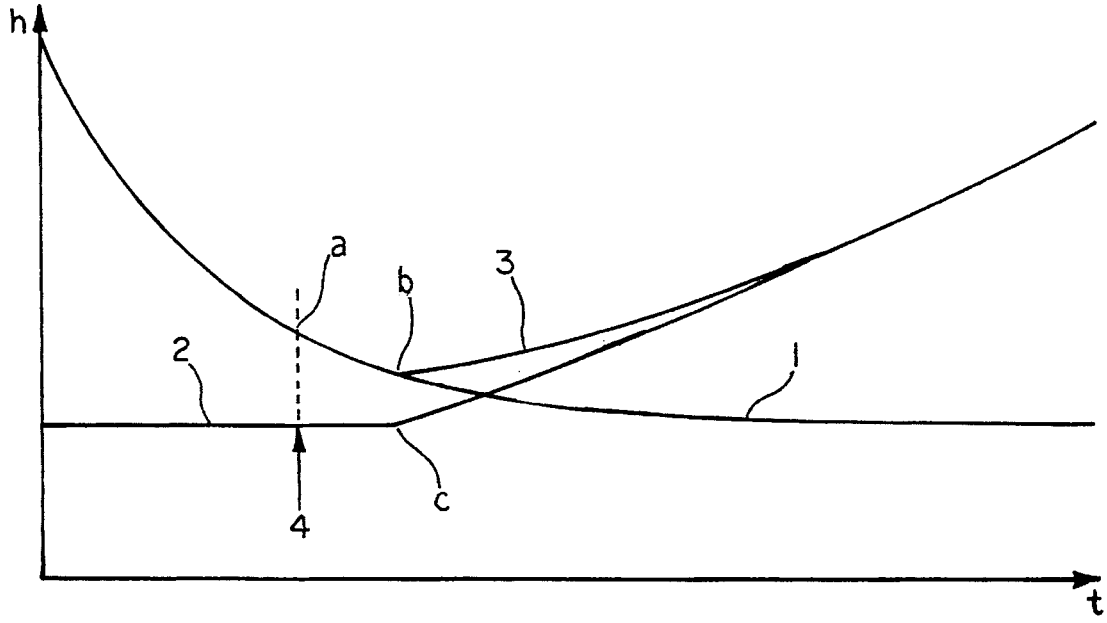
Figure 3:
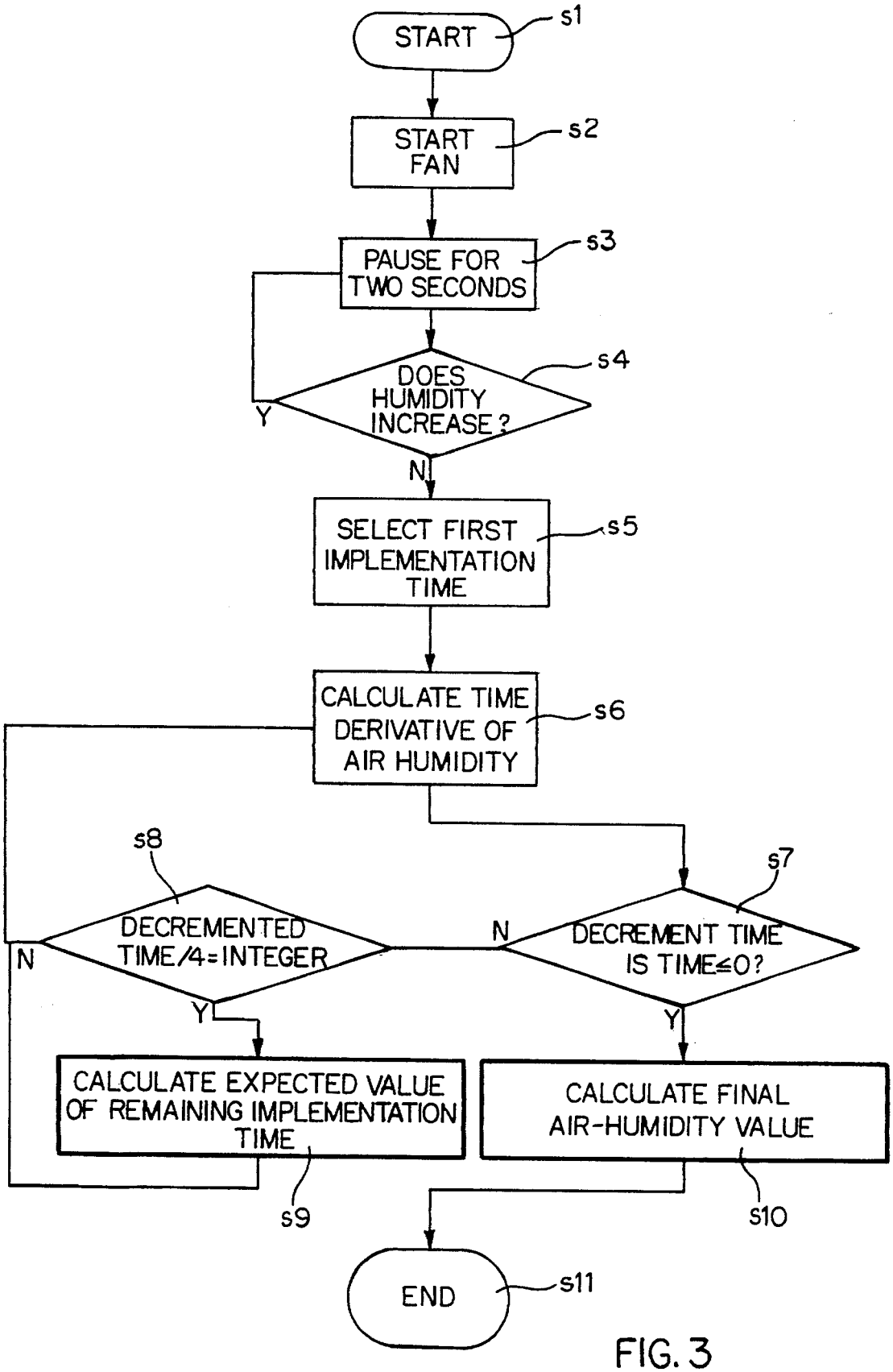

In the following, the inventive method will be described in connection with a non-restricting embodiment of the inventive microwave oven and with reference to the accompanying drawings, in which FIG. 1 is a block diagram for the relevant functional units of the microwave oven, FIG. 2 is a humidity-time diagram illustrating the variation over time of the residual humidity, as well as the humidity emission from the food or dish, and FIG. 3 is a program flow chart for the humidity-sensing control method according to the invention.

Since the detailed mechanical construction of the microwave oven is of no consequence to a full understanding of the invention, reference will here merely be made to the applicant's microwave ovens available on the market, e.g. the oven types VIP20 and V27, as well as to the applicant's SE Patent Applications 9402061-7, 9402062-5 and 9402063-3.

The block diagram of FIG. 1 shows the control unit 1 with the microprocessor and the associated program store 2. The user information is inputted to the control unit via the block 3, which represents operating means provided on the oven control panel, which also has a display 4 controlled by the control unit. The display 4 may, for instance, be used for verifying the selections made by the user via the control panel, and for providing information on how the cooking or heating proceeds, e.g. the remaining time.

Via a driver 5 and a microwave power unit 6, the control unit 1 controls the microwave radiation source 7 and, hence, the feeding of microwaves to the cavity 8. Via a driver 9, the control unit 1 controls a grill element 10 arranged in the ceiling of the cavity and, hence, the IR radiation fed to the cavity 8. As to the more detailed construction of the functional units represented by the blocks, reference is made to the above-mentioned types of microwave ovens manufactured by the applicant.

The residual humidity existing when starting the microwave oven, as well as the humidity emission from the food or dish being cooked, is sensed by a humidity sensor 11 provided in the evacuation channel for the ventilating air from the cavity 8. The sensed information from the humidity sensor 11 is returned to the control unit 1 as a control parameter.

In the humidity-time diagram of FIG. 2, the vertical axis represents the air humidity h, and the horizontal axis represents the time t. The curve 1 illustrates the exponentially decreasing graph of the residual humidity, preferably found in the cavity 8 but also in the evacuation channel mentioned above. The curve 2 represents the humidity emission from the food or dish being heated in the cavity. To begin with, the humidity value of the curve 2 is on a constant level equal to the humidity value of the surrounding air. At the time indicated by the arrow 4, the heating procedure is started, and after some time the curve 2 presents an elbow at the point c, which indicates that the food or dish begins to emit humidity. As appears from the diagram, the sloping residual-humidity curve 1 levels out and eventually stabilises at a value corresponding to the initial, constant humidity level of the curve 2, i.e. the humidity value of the surrounding air. The curve 3 represents the utility signal sensed by the humidity sensor. Up to the elbow c of the curve 2, the curve 3 coincides with the sloping curve 1 for the residual humidity, and after the elbow c, it agrees with the sum of the relative contributions, in relation to the humidity level of the surrounding air, from the increasing humidity emission from the food and the contribution from the level of the decreasing residual humidity.

The diagram of FIG. 2 illustrates the errors in measurement that occur when applying the prior-art technique taught by the above-mentioned patents. In the case of EP 0 289 000, the value of the residual-humidity curve would, at the start, be sensed as an incorrect reference value at the point a, and in the case of EP 0 078 607, the value of the residual-humidity curve would be sensed as an incorrect lowest humidity value at the point b.

When implementing the invention, an expected final residual-humidity value corresponding to the declining level of the residual-humidity curve 1, i.e. a value essentially corresponding to the humidity level of the surrounding air, is calculated. Also when applying such an improved reference value according to the invention, the humidity sensor will initially, after the procedure has been started, sense a too-high humidity level until the residual humidity virtually has disappeared and no longer provides-any measurable contributions. According to the invention, this error in measurement can be eliminated by correcting the sensed humidity values in view of the relative contributions from the residual humidity. Basically, this can be done with optional accuracy, since the exponentially sloping residual-humidity curve 1 can be calculated with a knowledge of two points on the curve. However, this error in measurement is more expediently eliminated by introducing a correction based on the derivative of the residual-humidity curve at the start (indicated by the arrow 4) multiplied by the time up to the sensing carried out by the humidity sensor.

The program flow chart of FIG. 3 illustrates the calculation of a final residual-humidity value for the oven and the establishment of this value as a reference value for a subsequent humidity-sensor-controlled cooking procedure. The program runs through the following steps, in which Y represents "yes" and N represents "no".

s1. Start the program.

s2. Start the fan of the ventilating device.

s3. Wait for 2 sec.

s4. Does the air-humidity level increase? If Y, return to s3. If N, proceed to s5.

s5. Select a predetermined first implementation time for the calculation. Proceed to s6.

s6. Set the selected first implementation time, or an estimated expected value of the remaining implementation time from s9. Decrement the implementation time towards zero. Calculate the time derivative of the air humidity. Proceed to s7.

s7. Every whole second: Decremented set time ≦0? If Y, proceed to s10. If N, proceed to s8.

s8. Decremented time/4 =integer? If N, return to s6. If Y, proceed to s9.

s9. Calculate the expected value of the remaining implementation time. Return this time value to s6.

s10. Calculate the expected final air-humidity value. Select the final air-humidity value as reference value for the humidity-sensor control. Proceed to s11.

s11. End the program.

As the first implementation time, one chooses a predetermined value, e.g. 100 sec, sufficient to make the program enter its main loop, i.e. steps s6, s7, s8 and s9.

Step s8 is based on the chosen condition that the expected value of the remaining implementation time in step s9 is calculated anew every fourth second. Naturally, another calculation periodicity is conceivable.

The calculation of the expected value of the remaining implementation time in step s9 is based on the sensed value of the time derivative of the air humidity, the decremented time and an algorithm for time calculation as follows $$IT=c\bullet(a/Dt+B\bullet|dh(t)/dt|)$$

wherein

IT is the calculated expected value of the remaining implementation time h(t) is the time function of the decreasing residual humidity Dt is the counted time after step s5, i.e. when the air humidity has stopped to increase a,b,c are empirical constants For every calculation, the value of the remaining implementation time decreases, as a function of the total time Dt used as well as the decreasing derivative of the levelling-out residual-humidity curve.

The calculation of the expected final residual-humidity value is based on the sensed air humidity, the current expected value of the remaining time, the last-sensed value of the humidity derivative, and the following algorithm for humidity calculation $$EH=HO-f\bullet|dh(t)/dt|\bullet(e\bullet IT-d)$$

wherein

EH is the calculated expected final air-humidity value,

HO is the air humidity at the calculation time

IT is the current calculated expected value of the remaining implementation time d,e,f are empirical constants h(t) is the time function of the decreasing residual humidity.

The above time function for calculating the humidity derivative may, in actual practice, be simplified by calculating the time derivative as the decrease of the humidity signal during, say, the last 10 sec. In the above algorithms, dh(t)/dt is then replaced with $\Delta h/\Delta t$.

It will be appreciated that those skilled in the art are well qualified to devise modifications of the above method within the scope of the invention. For instance, the microprocessor program flows described above may be realised by so-called fuzzy logic decisions. Any modifications needed to enable the use of fuzzy logic are but measures of convenience to be regarded as encompassed by the scope of the appended claims.

I claim:

1. A method for controlling, in a microwave oven, a procedure for cooking or heating food or a dish of food, which includes sensing the humidity emission from the food during the cooking or heating procedure, said oven comprising a cavity (8), to which is connected a microwave radiation source (7) for supplying microwave radiation to the cavity, a control unit (1) operably connected to the microwave radiation source for controlling the activation of the microwave radiation source to feed microwaves to the cavity, a humidity sensor (11) positioned within oven and connected to the control unit for returning a sensed humidity value as a control parameter to the control unit, and a device adapted to ventilate the cavity, the device being connected to the control unit, fluidly connected to the cavity and controllable by the control unit, characterized by the steps of actuating the ventilating device for initial removal of residual humidity from the oven, calculating an expected final air-humidity value from the residual humidity during said initial removal on the basis of the sensed humidity values and an algorithm for humidity calculation, and using the calculated final air-humidity value as a reference value for the cooking or heating procedure.

2. A method as set forth in claim 1, characterised by the steps of starting the calculation of the expected final air-humidity value only after the air humidity in the vicinity of the humidity sensor has begun to decrease after the actuation of the ventilating device, and basing the calculation of the final air-humidity value on repeated calculations of the variation of the air humidity over time.

3. A method as set forth in claim 2, characterised by calculating the expected final air-humidity value by the steps of setting a predetermined first implementation time for the calculation, repeating the following sequence of substeps calculating the time derivatives of the air humidity continuously, decrementing the implementation time towards zero, calculating an expected value of the remaining implementation time on the basis of said time derivative, the counted time and an algorithm for time calculation, and setting the calculated expected value as a new implementation time, ending the sequence when the set remaining implementation time has been decremented to zero, and calculating the final air-humidity value on the basis of the sensed air humidity, the expected value of the remaining implementation time and the last-calculated value of the time derivative.

4. A method as set forth in claim 1, characterised by the steps of compensating the sensed humidity values for the remaining residual humidity during the initial phase of the cooking or heating procedure, and basing this compensation on information obtained in previous calculations.

5. A microwave oven for cooking or heating food, comprising a cavity (8), to which is connected a microwave radiation source (7) for supplying microwave radiation to the cavity, a control unit (1) operably connected to the microwave radiation source for controlling the activation of the microwave radiation source to feed microwaves to the cavity, a humidity sensor (11) provided within the oven and connected to the control unit for sensing the humidity emission from the food and returning the sensed humidity value as a control parameter to the control unit, and a device adapted to ventilate the cavity, the device being connected to the control unit, fluidly connected to the cavity and being controllable by the control unit, characterized in that the control unit operates to actuate the ventilating device for initial removal of residual humidity from the oven when starting a cooking or heating procedure, calculating means are provided for calculating an expected final air-humidity value from the residual humidity during said initial removal, and the control unit operates to utilize the calculated final air-humidity value as a reference value for the humidity-sensor control.

6. A microwave oven as set forth in claim 5, in which the control unit comprises a microprocessor for the humidity-sensor control, characterised in that the microprocessor is programmed to implement the following steps when calculating the expected final air-humidity value receiving sensed values of the air humidity from the humidity sensor, establishing the beginning of a decrease of the air humidity, setting a predetermined first implementation time for the calculation, decrementing the set implementation time towards zero, calculating the time derivative of the decreasing air humidity continuously, on the basis of an assumed time function for the decreasing air humidity, calculating an expected value of the remaining implementation time on the basis of the time derivative, the counted time and an established algorithm for time calculation, setting the expected value as a new implementation time and repeating the preceding steps, ending the procedure when the implementation time last calculated and set has been decremented to zero, and calculating the expected final air-humidity value on the basis of the sensed air humidity, the expected value of the remaining implementation time, and the last-calculated value of the humidity derivative with the aid of an established algorithm for humidity calculation.

7. A microwave oven as set forth in claim 6, in which the algorithm for time calculation is $$IT=c\bullet(a/Dt+B\bullet|dh(t)/dt|)$$

wherein

IT is the calculated expected value of the remaining implementation time h(t) is the time function of the decreasing residual humidity Dt is the time counted since step s5, i.e. when the air humidity has stopped increasing a,b,c are empirical constants.

8. A microwave oven as set forth in claim 6, characterised in that the algorithm for humidity calculation is $$EH=HO-f\bullet|dh(t)/dt|\bullet(e\bullet IT-d)$$

wherein

EH is the expected final air-humidity value,

HO is the air humidity at the time of calculation

IT is the current calculated expected value of the remaining implementation time d,e,f are empirical constants h(t) is the time function of the decreasing residual humidity.

9. A microwave oven as set forth in claim 5, characterised in that the humidity sensor is arranged in an evacuation channel for the cavity.

10. A microwave oven as set forth in claim 5, characterised in that it is provided with selectable, automatic cooking or heating programs for specific types of food or dishes, the programs being selected by inputting food-category information based on the type of food and its initial state.

* * * * *